United States Patent [19]

Aikman

[11] 4,411,087

[45] Oct. 25, 1983

[54] TRIGGER MECHANISM FOR FIREARMS

[76] Inventor: Floyd O. Aikman, 27 Roberta Dr., Howell, N.J. 07731

[21] Appl. No.: 199,711

[22] Filed: Oct. 23, 1980

[51] Int. Cl.[3] ..... F41C 19/00

[52] U.S. Cl. ..... 42/69 A

[58] Field of Search ..... 42/69 A, 69 B, 69 R

[56] References Cited

U.S. PATENT DOCUMENTS

| | | | |
|---|---|---|---|
| 1,215,181 | 2/1917 | Newton | 42/69 A |
| 1,243,120 | 10/1917 | Williams | 42/69 A |
| 1,581,763 | 4/1926 | Newton | 42/69 A |
| 2,514,981 | 7/1950 | Walker et al. | 42/69 A |
| 2,856,717 | 10/1958 | Parke | 42/69 A |
| 2,935,808 | 5/1960 | Woodring et al. | 42/69 A |
| 3,075,312 | 1/1963 | Walker | 42/69 R |

*Primary Examiner*—Charles T. Jordan
*Assistant Examiner*—Ted L. Parr
*Attorney, Agent, or Firm*—Blair, Brown & Kreten

[57] ABSTRACT

A trigger mechanism for a firearm such as a pistol having a firing pin spring loaded into a firing position and held in a retracted position by a spring loaded sear together with a sear trip bar pivotally movable by a manually operated lever pivotally mounted on the exterior of a housing for the firearm trigger into retaining engagement with a release lever spring loaded against the trigger so that manual actuation of the trigger permits movement of the release lever out of engagement with the sear trip bar into tripping engagement with the sear for releasing the firing pin to fire the firearm.

7 Claims, 9 Drawing Figures

FIG 1
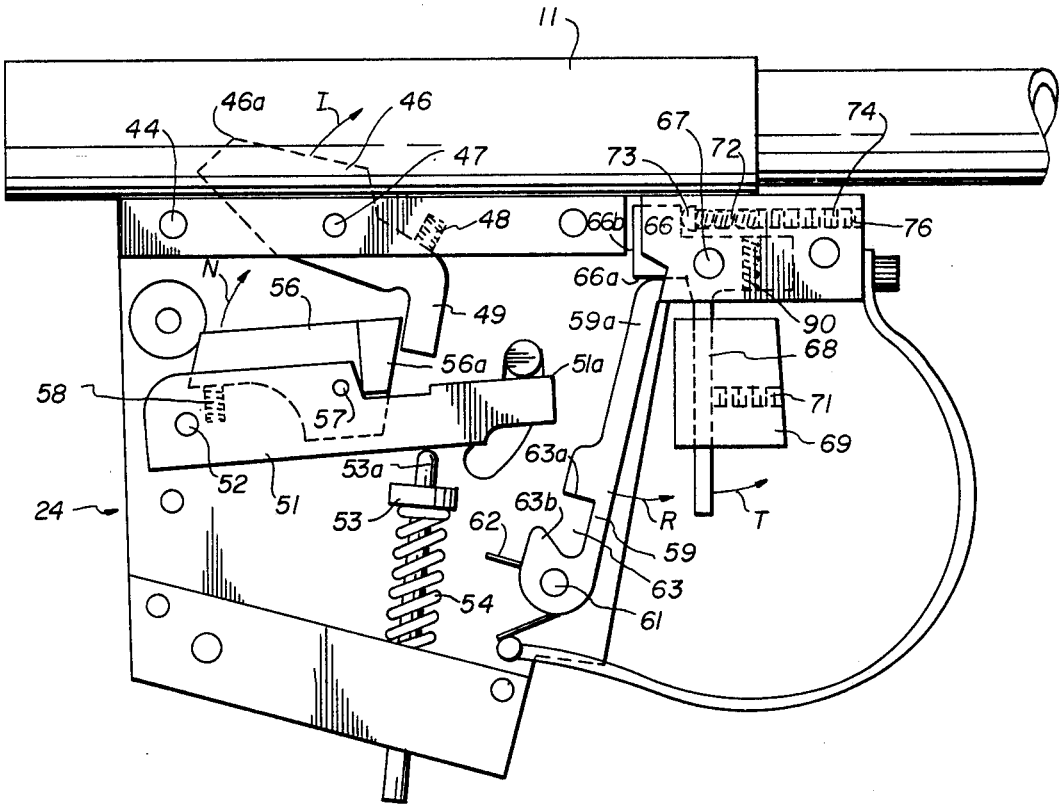
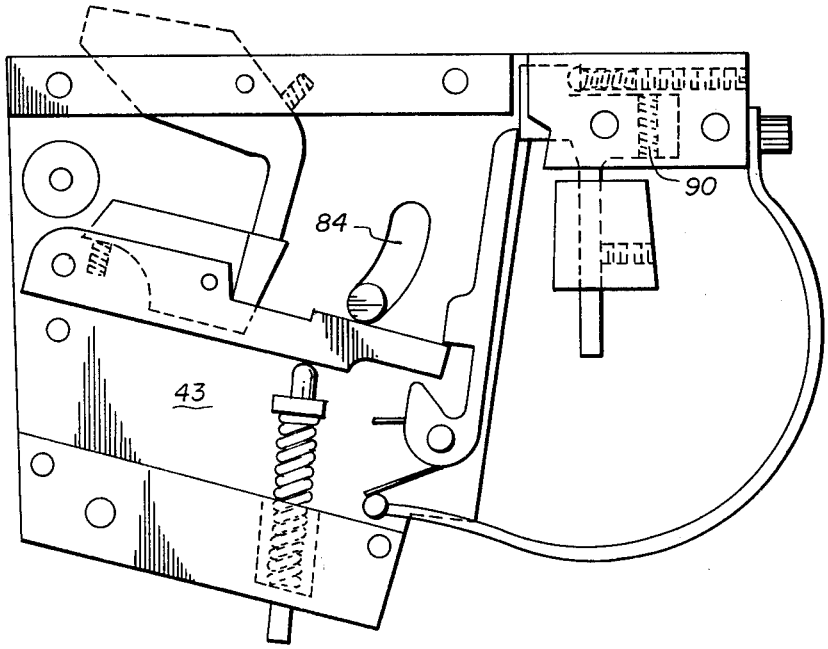
FIG 2

44
79
87
78
86
82
83
42
44
M
81

42

29
26
27

34
33
32
31
29
26
27
28
36
37

FIG 7
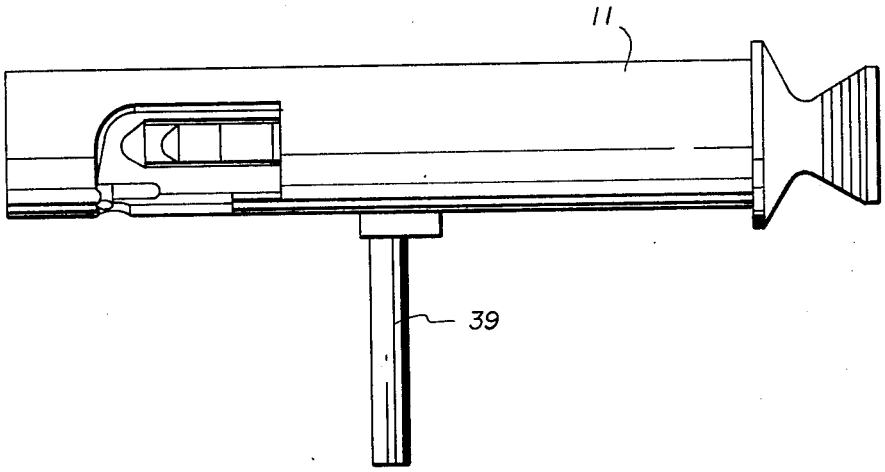
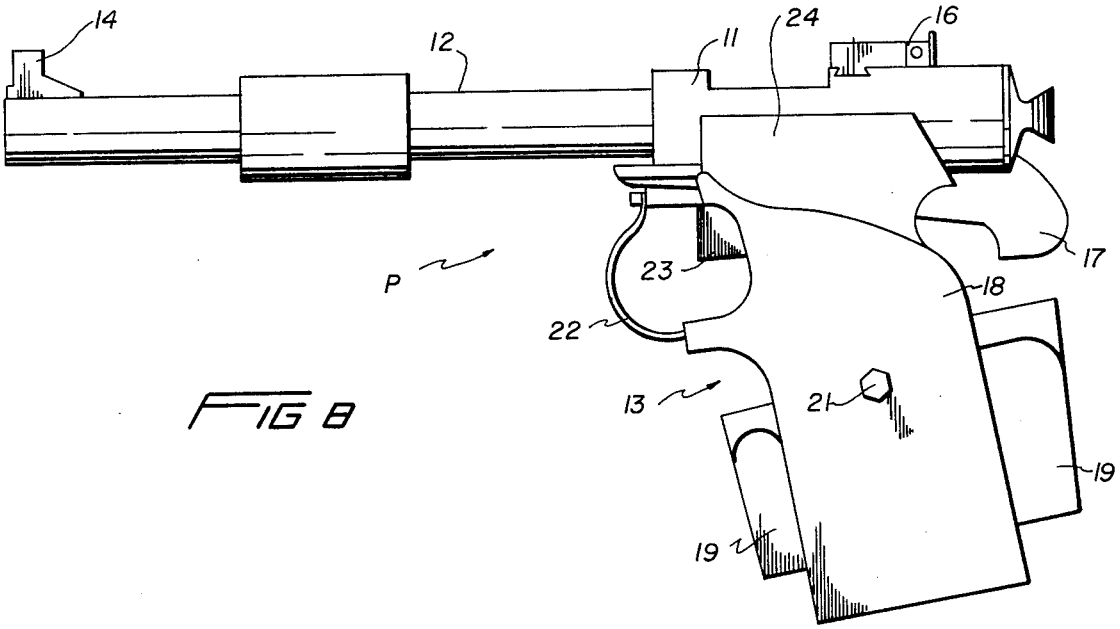
FIG 8
FIG 9
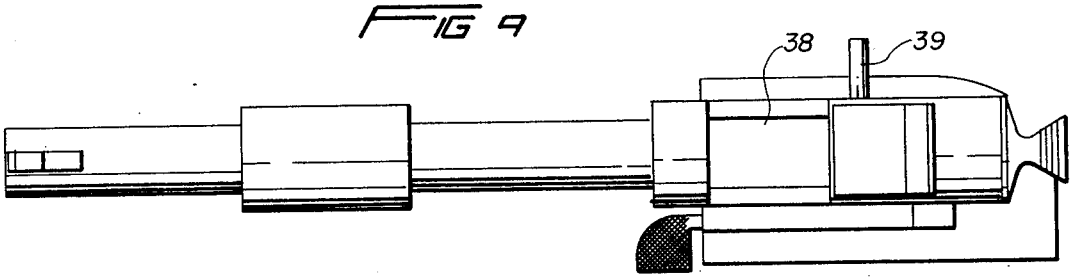

TRIGGER MECHANISM FOR FIREARMS

BACKGROUND OF THE INVENTION

The popularity of firearms today, particularly firearms used by sportsmen and the like, has led to a substantial increase in the interest in competitive shooting such as international competition in pistol and rifle events. Such international events as the Olympics have promoted increased emphasis on the design of firearms which provide a maximum degree of accuracy. While the basic design of firearms utilized for target shooting has remained essentially the same, efforts have been directed to produce firearms which permit the competitor to maintain the weapon as steady as possible and to reduce the effect of external forces such as body tremors, heartbeat, breathing and the like on the firearm during use. Obviously, the effects of the trigger pull on the steadiness of the firearm is a major consideration in reducing movement of the firearm during target shooting, and it has long been recognized that an improvement in trigger action is an essential element in improving the accuracy of the firearm. This is particularly true in the area of pistol target shooting wherein the pistol is supported mainly during competitive target shooting by the hand of the competitor.

In an effort to reduce inadvertent movement of the firearm during competitive shooting, present day designs have concentrated mainly on the trigger and firing mechanisms. A variety of component parts, with this objective in mind, have been utilized in present-day weapon design which, while contributing somewhat to compensating for the tendency of the firearm to move off target when the trigger is pulled, add considerably to the weight and complexity of the firearm construction and still fall short of the desired degree of improvement. Furthermore, such complex constructions in present-day firearms not only make assembly and disassembly of the firearm protracted and difficult, but also add considerably to the cost of the firearm and to the required periodic maintenance.

OBJECTS AND SUMMARY OF THE INVENTION

Accordingly, the primary object of this invention is to provide a new and novel firearm such as a pistol or the like which is characterized by a high degree of accuracy for target shooting.

Another object of this invention is to provide a new and novel trigger mechanism for a firearm which minimizes the effect of the trigger pull on the movement of the firearm during target shooting and which provides a high degree of trigger pull smoothness and control with the desired trigger pull force.

A further object of this invention is to provide a new and novel trigger mechanism for a firearm such as a pistol which is extremely simple and inexpensive in construction, may be easily assembled and disassembled in a minimum of time and which is capable of prolonged use without breakdown.

Still another object of this invention is to provide a new and novel pistol having a trigger mechanism which permits the use of the pistol for competitive target shooting with a high degree of accuracy and which may be fired by the competitor with virtually no concern for movement of the pistol during the actuation of the trigger.

The objects stated above and other related objects are accomplished by the provision of a firearm which includes a receiver having a slidable bolt in which a firing pin is slidably urged from a retracted position into a firing position together with a trigger housing having a sear pivotably mounted therein which is yieldingly urged into retaining engagement with the firing pin in the retracted position. Trip means are pivotably mounted in the trigger housing for movement between a first position and second position against the force of a spring by means of a lever pivotably mounted on the outside of the trigger housing. A release lever having a notch for retaining the trip means in the second position is also pivotably mounted on the trigger housing and is yieldingly urged by a spring against a trigger, yieldingly urged in one direction by a spring. Rotation of the trigger in the opposite direction permits the release lever to move out of retaining engagement with the firing pin for movement of the firing pin from the retracted position into the firing position.

The invention will be better understood as well as further objects and advantages thereof will become more apparent from the following detailed description taken in conjunction with the drawings.

BRIEF DESCRIPTION OF THE DRAWINGS

FIG. 1 is a side elevation view of a trigger mechanism constructed in accordance with the invention in relaxed position of operation;

FIG. 2 is a view similar to FIG. 1 showing the trigger mechanism of the invention in the set position;

FIG. 7 is a side view of a portion of the firearm incorporating the trigger mechanism of the invention;

FIG. 8 is a side elevational view of a firearm incorporating the trigger mechanism of the invention; and FIG. 9 is a plan view of the firearm of FIG. 8.

DESCRIPTION OF THE PREFERRED EMBODIMENT

Figures 3, 4, 5, 6:
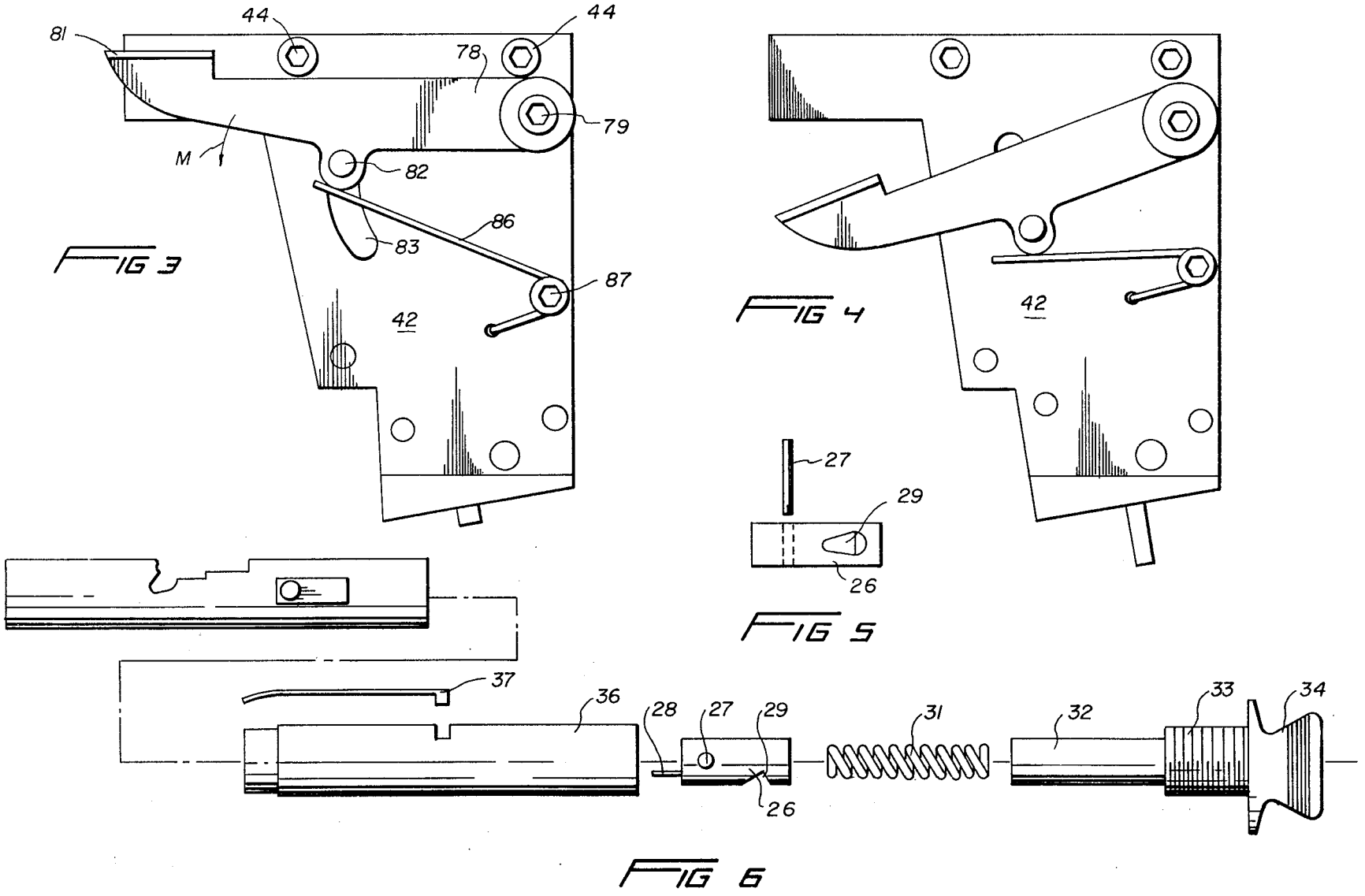
FIG. 3 is a side elevational view of the exterior of the trigger mechanism of FIG. 1 in one position of operation.
FIG. 4 is a view similar to FIG. 3 showing the parts in another position of operation.
FIG. 5 is a bottom view of a firing pin utilized in the firearm with which the trigger mechanism of the invention is associated.
FIG. 6 is an exploded view of a portion of the firearm incorporating the trigger mechanism of the invention.

Referring to the drawings now and to FIGS. 8 and 9 specifically, there is shown a pistol incorporating the trigger mechanism of the invention which is designated generally by the letter P. In the illustrated embodiment, the pistol P is specifically designed for target shooting and more particularly a 22 caliber pistol suitable for Olympic competition. As is well-known, such a target pistol P includes a receiver 11 having a barrel 12 with a handgrip 13 and front and rear sights 14,16, suitable gripping panels 17–19 being provided on the pistol handgrip 13 and retained thereon by means of a stock screw 21. The pistol P also includes a trigger guard 22 disposed forwardly of a trigger 23 and a trigger housing 24, constructed in accordance with the invention, is suitably attached to the receiver 11.

As shown best in FIGS. 5–7, the pistol P is a bolt-action type including well-known component parts such as a firing pin 26 provided with a firing pin retractor pin 27 and prong 28 together with a sear engagement notch 29 as shown best in FIG. 5. The firing pin 26 is spring-loaded from a retracted position into a firing position by means of a spring 31 disposed within a bolt cap 32 having a threaded portion 33 and an end knob 34 as shown best in FIG. 6.

The firing pin 26 is slidably disposed within the bore of a bolt 36 provided with an extractor 37 which bolt 36 is operatively associated with a bolt lock and sleeve 38 having an operating lever 39 for rotating and sliding the bolt lock and sleeve 38 for placing a cartridge in the chamber of barrel 12 and for closing of the bolt lock and sleeve 38 with the cartridge in the firing position.

As specifically illustrative of the invention and referring now to FIGS. 1 and 2, the housing 24 of the trigger mechanism 23 of the invention includes a pair of spaced plates 42,43 as shown best in FIGS. 2, 3,4 secured in spaced-apart relationship to the receiver 11 by means such as capscrews 44 to define an interior therebetween.

The trigger mechanism of the invention includes a sear 46 pivotally mounted on the trigger housing 24 by means of pivot pin 47. The sear 46 is provided with an edge portion 46*a* and is yieldingly urged in the direction of the arrow I by means such as a spring 48 into the position shown in FIG. 1 for retaining engagement between the edge portion 46*a* and the notch 29 in the firing pin 26. The sear 46 is also provided with a downwardly projecting extension 49 as shown in FIG. 1.

The trigger mechanism 23 of the invention also includes trip means pivotally mounted in the trigger housing 24 for movement between a relaxed position as shown in FIG. 1 and a set position as shown in FIG. 2. In the illustrated embodiment, the trip means comprises a sear trip bar 51 pivotally mounted within the interior of the trigger housing 24 by means of pivot pin 52. The sear trip bar 51 is yieldingly urged into the position of FIG. 1 by urging means such as a rod 53 having a tip 53*a* engageable with the lower surface of the sear trip bar 51. The rod 53 is supported for longitudinal movement within the trigger housing 24 and is urged upwardly into engagement with the sear trip bar 51 by means such as a spring 54.

Sear tripping means are mounted on the sear trip bar 51 for tripping the sear 46 which, in the illustrated embodiment, comprises a sear trip 56 mounted pivotally on the sear trip bar 51 by means of pivot pin 57, the sear trip 56 is yieldingly urged in the direction of the arrow N by urging means such as a spring 58. The sear trip 56 includes a nose portion 56*a* for engagement with the extension 49 on the sear 46 as will be explained hereinafter.

The trigger mechanism 23 of the invention also includes release means pivotally mounted on the trigger housing 24 for retaining engagement with the sear trip bar 51 in the set position of the bar as shown in FIG. 2. More specifically, the release means comprises a release lever 59 pivotally mounted on the trigger housing 24 by means of pivot pin 61 and yieldingly urged in the direction of the arrow R by means such as a spring 62. The release lever 59 includes a notch 63 having edge portions 63*a*; and 63*b*. In the set position of the sear trip bar 51, as shown in FIG. 2, the outer end 51*a* of bar 51 engages within notch 63 retaining the bar 51 in the set position.

The outer end 59*a* of the release lever 59 is arranged to engage a body 66 of the trigger 23 which is pivotally mounted on the trigger housing 24 by means of a pivot pin 67. The trigger 23 also includes a rod member 68 preferably formed integrally with the trigger body 66 and which extends downwardly for manual actuation by the finger of the competitor. The rod member 68 is preferably provided with a counterweight 69 slidably mounted on the rod member 68 and secured in an adjusted position by suitable means such as a set screw 71.

Means are provided for yieldingly urging the trigger 23 in the direction of the arrow T which, in the illustrated embodiment, comprises a spring 72 and a rod 73 associated therewith disposed within a recess 74 in the trigger housing 24. Preferably, a set screw 76 is disposed within the recess 74 for retaining the spring in threaded engagement with a corresponding threaded portion in the recess 74. The trigger body 66 includes two edge portions 66*a* and 66*b* which are arranged to be engaged successively, as will be explained hereinafter, by the tip or end portion 59*a* of the release lever 59. Set screw 90 provides adjustment for trigger body 66 as it engages the trigger housing 24.

Referring now to FIGS. 3 and 4, means are provided for moving the sear trip bar 51 from the relaxed position of FIG. 1 into the set position of FIG. 2 in retaining engagement with the notch 63 of the release lever 59. More specifically, a manually operated set trigger lever 78 is pivotally mounted at one end exteriorly of the trigger housing 23 by means of a pivot bolt 79. The other end of the lever 78 is provided with a laterally extending flange 81 for easy manipulation of the lever 78. The trigger lever 78 is also provided with a laterally extending lug 82 which is arranged to extend through a pair of laterally aligned, arcuate slots 83,84 in the housing side plates 42,43. As shown best in FIGS. 1 and 2 the lug 82 is arranged to engage the upper surface of the sear trip bar 51.

Means are provided for yieldingly urging the set trigger lever 78 into the upper position of FIG. 3 which, in the illustrated embodiment, comprises a spring 86 supported on the trigger housing 23 by means such as a pivot pin 87. The set trigger lever 78 is arranged to be moved downwardly in the direction of the arrow M in FIG. 3 into a lower position as shown in FIG. 4 against the urging force of spring 86 to move the sear trip bar 51 from the relaxed position of FIG. 1 into the set position of FIG. 2 for locking engagement of the bar 51 with the notch 63 in the release lever 59.

The operation of the trigger mechanism of the invention is as follows:

1. BOLT OPERATION

When the bolt lock and sleeve 38 is rotated counterclockwise, a cam surface retracts the firing pin 26. Firing pin retractor pin 27 rides on the cam surface to move the firing pin. As the bolt lock and sleeve 38 is rotated the bolt guide keeps the bolt lock and sleeve 38 in alignment. The body of bolt 36 houses the firing pin 26 and extractor 37. When the bolt 36 is pulled to the rear, the chamber of barrel 12 is exposed for loading with a cartridge. When the bolt lock and sleeve 38 is pushed forward, the sear spring 48 rotates sear 46 clockwise for engagement of the sear portion 46*a* with the sear engagement notch 29 on the firing pin 26. Continued forward movement of the bolt lock and sleeve 38 with clockwise rotation locks the bolt lock and sleeve 38 in place so that the firing pin 26 is now in the retracted position.

2. TO SET THE SET TRIGGER

The set trigger lever 78 is depressed until the outer end 51*a* of the set trip bar 51 engages the wall 63*b* of the notch 63 on the release lever 59. Further downward movement of the set trigger lever 78 rotates release lever 59 counter-clockwise wiping past the trigger body 66. When the set trigger lever 78 is released, the outer end of the release lever 59 will rest against the trigger body portion 66*a* of the trigger 23 as the trigger is spring loaded and returns to the engaged position.

3. TO RELEASE THE SET TRIGGER

The trigger 23 is rotated in a direction opposite to the arrow T and sear trip bar release spring 62 will rotate release lever 59 in the direction of the arrow R. This movement of the release lever 59 will release the sear trip bar 51 from the notch 63, which is under tension by the spring 54 and the main spring guide 53. Spring 54 forces the sear trip bar 51 from the second position of FIG. 2 upwardly and the sear trip 56 is pushed against the extension 49 on the sear 46. Thus, the sear 46 is rotated in a direction opposite the I arrow disengaging portion 46*a* from the firing pin notch 29 and the firing spring 31 moves the firing pin 26 from the retracted to the firing position.

4. TO LOAD AND FIRE FROM DISCHARGED POSITION

Rotate bolt lock and sleeve 38 and pull to the rear. Place a cartridge in the chamber and close the bolt lock and sleeve 38. Push down on the set trigger lever 78 contacting the sear trip bar 51 so that sear trip 56 wipes against the back of the sear extension 49. When sear trip bar 51 is pushed down far enough, sear trip 56 will clear the back of sear extension 49. Sear trip spring 58 will return the sear trip 56 to the firing position. Continue the downward movement of the sear trigger lever 78 for engagement between trip bar 51, release lever 59 and the trigger 23. The set trigger lever 78 is then released and the pistol P is ready to fire.

I claim:

1. A trigger mechanism for a firearm such as a pistol or the like including a receiver, a bolt slideably disposed in said receiver, a firing pin slideably disposed in said bolt and means for yieldingly urging said firing pin from a retracted position into a firing position, a trigger housing mounted on said firearm, a trigger pivotally mounted on said housing, means for yieldingly urging said trigger in one direction of rotation, a sear pivotably mounted on said housing, means for yieldingly urging said sear in one direction of rotation for retaining engagement with said firing pin in said retracted position, trip means pivotally mounted on said trigger housing for movement between a first position and a second position, means for yieldingly urging said trip means from said first position into said second position, release means pivotally mounted on said trigger housing for retaining engagement with said trip means in said second position, means for yieldingly urging said release means into engagement with said trigger in a direction of rotation opposite said one direction of rotation of said trigger whereby rotation of said trigger in the opposite direction of rotation permits further movement of said release means out of said retaining engagement with said trip means and movement of said trip means into said first position for engagement with said sear to pivot said sear in the opposite direction of rotation out of said retaining engagement with said firing pin for movement of said firing pin from said retracted position into said firing position wherein said trigger includes a body pivotally mounted on said housing and a rod member for manually pivoting said trigger in said opposite direction, said trigger body including a stepped rear portion forming first and second surfaces, said release means being movable into one position in engagement with said first surface for retaining engagement with said trip means and being movable into a second position in engagement with said second surface for releasing said trip means wherein said trip means comprises a sear trip bar pivotally mounted at one end on said trigger housing, said trip bar having an outer end portion for retaining engagement with said release means in said second position, a sear trip pivotally mounted on said sear trip bar, spring means for yieldingly urging said sear trip in one direction of rotation into firing position, said sear trip being arranged to rotate in the opposite direction of rotation against said spring means for urging engagement with said sear in said firing position during the movement of said sear trip bar from said first position into said second position and into engagement with said sear during the pivotal movement of said sear trip bar from said second position into said first position for pivoting said sear out of retaining engagement with said firing pin.

2. A trigger mechanism in accordance with claim 1 wherein said release means comprises a lever pivotally mounted at one end on said trigger housing, said release lever having a rearwardly opening notch for accomodating said sear trip bar outer end portion in retaining engagement therewith and wherein said means for yieldingly urging said release means in said direction of rotation comprises a spring, said notch having a side wall engageable by said sear trip bar past said second position to rotate said release lever in an opposite direction of rotation for engagement of the other end of said release lever with said trigger body's first surface.

3. A trigger mechanism in accordance with claim 2 wherein said lever means comprises a set trigger lever pivotally mounted exteriorly on said trigger housing for pivotal movement between an upper position and a lower position, a laterally extending lug on said set trigger into said upper position, said lug being engageable with said sear trip bar for moving said bar from said first position to said second position during the movement of said set trigger lever from said upper position into said lower position.

4. A trigger mechanism in accordance with claim 3 wherein said trigger housing comprises a pair of side plates arranged in spaced apart relationship to define an interior and wherein said sear, sear trip bar, said trip and release lever are disposed within said interior and wherein said side plates are provided with a pair of arcuately shaped, laterally aligned slots for guidably accomodating said lug.

5. A trigger mechanism in accordance with claim 4 including a finger rest counterweight slidably mounted on said rod member and means for releasably securing said finger rest counterweight on said rod member in a slideably adjusted position.

6. A trigger mechanism in accordance with claim 5 wherein said means for yieldingly urging said trip means into said first position include a rod having an upper end slideably mounted on said trigger housing and a spring for yieldingly urging said rod upwardly for engagement of said rod upper end with the lower surface of said sear trip bar.

7. A trigger mechanism in accordance with claim 3 wherein said set trigger lever is pivotally mounted on said trigger housing intermediate its ends and wherein said lug is disposed adjacent one end of said set trigger lever and including a laterally projecting tab adjacent the other end of said set trigger lever for manual manipulation of said lever.

* * * * *